US005589916A

United States Patent [19]

Sutoh et al.

[11] Patent Number: 5,589,916

[45] Date of Patent: Dec. 31, 1996

[54] DEVELOPING APPARATUS

[75] Inventors: Masaki Sutoh; Shinichiro Fukunaga, both of Saitama, Japan

[73] Assignee: Fuji Xerox Co., Ltd., Tokyo, Japan

[21] Appl. No.: 250,486

[22] Filed: May 27, 1994

[30] Foreign Application Priority Data

May 28, 1993 [JP] Japan ..... 5-126668
Apr. 8, 1994 [JP] Japan ..... 6-070590

[51] Int. Cl.[6] ..... G03G 15/06

[52] U.S. Cl. ..... 399/286

[58] Field of Search ..... 355/251, 253, 355/245, 259; 118/656–658, 651; 430/105, 122, 123; 492/53, 54, 58, 59; 428/561, 639, 666

[56] References Cited

U.S. PATENT DOCUMENTS 5,177,538 6/1993 Mammino et al. ..... 355/259
5,369,478 11/1994 Kobayashi et al. ..... 355/259
5,517,286 5/1996 Tada et al. ..... 355/251

FOREIGN PATENT DOCUMENTS 1-276174 11/1989 Japan .
1-277265 11/1989 Japan .
3-41485 2/1991 Japan .
3-233581 10/1991 Japan .
4-309982 11/1992 Japan .
5-27581 2/1993 Japan .

*Primary Examiner*—Shuk Yin Lee
*Attorney, Agent, or Firm*—Finnegan, Henderson, Farabow, Garrett & Dunner, L.L.P.

[57] ABSTRACT

A developer support supplies a charge developer to an electrostatic latent image formed on an electrostatic latent image holder. The developer support has a nonmagnetic substrate in a shape of a hollow cylinder, wherein the substrate comprises at least one metal with an amorphous film formed on the nonmagnetic substrate. The amorphous film consists essentially of an element selected from Cr or Zn, the at least one metal, O, and H.

9 Claims, 4 Drawing Sheets

DEVELOPING APPARATUS

BACKGROUND OF THE INVENTION

This invention relates to a developing apparatus and a method for manufacturing a developer support and more particularly to a developing apparatus used with a copier or printer using electrophotographic technology and a method for manufacturing a developer support used with the developing apparatus.

With a copier or printer using electrophotographic technology, an electrostatic latent image is formed using photoconductive material and a charged developer is attracted to the electrostatic latent image for making it visible by developing. A cylindrical developer support is used to supply the developer to be attracted. At such developing apparatus, the supply amount of the developer to the electrostatic latent image must be an amount responsive to the charge potential of the electrostatic latent image. However, when a developer comprising particles or being high in charge performance is used, a developing capability distribution occurs in the developer on the developer support due to a developing history and supplying the developer in response to the charge potential may not be performed. This phenomenon is called a ghost, the cause of which can be described qualitatively as follows:

FIG. 4 shows an outline of the configuration of a developing apparatus using a magnetic developer. The developing apparatus comprises a developer support 11, a magnet 12, a developer hopper 13, and a developing blade 14. A developer 15 is stored in the developer hopper 13. The developer is attracted to the developer support 11 by a magnetic force of the magnet 12. As the developer support 11 rotates, the developer that adheres on the developer support is controlled to a predetermined film thickness by means of the developing blade 14. The developer is charged due to friction of the developer components against each other or friction of the developer against the developing blade. The charged developer is transferred to an electrostatic latent image on an electrostatic latent image holder 16 by a Coulomb force at a place near the electrostatic latent image holder, making the electrostatic latent image visible by developing. When the electrostatic latent image is made visible by developing, only the part of the developer on the developer support 11 positioned in the portion corresponding to the electrostatic latent image is consumed. As the developer support rotates, a new developer part is supplied to the consumed part and charged by means of the developing blade 14.

Since development is performed by such operation, the new developer part supplied to the developer consumption portion at the developing step is charged only once due to friction by means of the developing blade, but any other part, namely, old part is again charged due to friction. Thus, the developer on the developer support 11 has a charge amount distribution responsive to a developing history. As the charge amount increases, Coulomb interaction between the developer and electrostatic latent image becomes strong and at the same time, attraction by a mirror imaging force also becomes strong between the developer and developer support. The transfer amount of the developer to the electrostatic latent image, namely, the developing capability is determined by the strength relationships among the forces. Thus, in the actual developing, the developing capability of the portion to which a new developer part is supplied may be high or low as compared with any other portion and an image different from the electrostatic latent image will appear on the print result accordingly.

For example, consider making a copy of a manuscript having a portion written as "GHOST" and a shaded area at a unique density, as shown in FIG. 5. Usually, the peripheral speed of the developer support 11 is fast as compared with that of the electrostatic latent image 16, but for convenience, assume that the former equals the latter. Also, assume that developing is performed from top to bottom in FIG. 5.

Since the length of the circumference of the developer support generally is shorter than the length of a manuscript, the developer support needs to rotate more than once to copy one sheet of manuscript. Assume that the length indicated by L in FIG. 5 is the length of the circumference of the developer support. By developing the portion, a developer layer having a developing capability distribution responsive to the electrostatic latent image, namely, a ghost is formed on the surface of the developer support, and the next portion is developed with the layer. At the time, if the developing capability of the developer part used for developing the characters is high as compared with any other developer part, an image not contained in the electrostatic latent image, called a positive ghost, appears on the developing result at the position responsive to the length of the circumference of the developer support, L, as shown in FIG. 6. In contrast, if the developing capability of the part is low, the electrostatic latent image exists, but is not developed, that is, a phenomenon called a negative ghost occurs.

The phenomenon relates to the charge performance of a developer as described above, thus becomes obvious particularly when a developer comprising particles or improved in charge performance developed to provide a high picture quality in recent years is used.

Techniques disclosed in Japanese Patent Laid-Open Nos.Hei 1-276174 and 1-277265 are known as techniques to cope with the ghost. In the techniques, a resin layer having conductivity and a surface lubricating ability consisting of phenol resin and carbon is formed on the developer support surface, thereby suppressing occurrence of a ghost.

However, the process wherein the resin layer is formed on the developer support surface has problems of complicated forming process of the resin layer, easy peeling-off of the resin layer because of weak adhesive strength of the resin layer and substrate, and a short term in which the ghost can be suppressed.

SUMMARY OF THE INVENTION

It is therefore an object of the invention to provide a developing apparatus capable of suppressing the ghost over a long period of time.

According to one aspect of the invention, there is provided a developing apparatus comprising a developer support for supplying a charged developer to an electrostatic latent image formed on the electrostatic latent image holder. The developer support has a nonmagnetic substrate in a shape of a hollow cylinder, wherein the substrate comprises at least one metal with an amorphous film formed on the nonmagnetic substrate. The amorphous film consists essentially of an element selected from Cr or Zn, the at least one metal, O, and H.

The substrate of the developer support in the invention may consist of a single material. It can also comprise a metal film consisting of one or more elements selected from the group consisting of Zn, Ni, Sn, Cu, Cr, and Al formed on a nonmagnetic material. The metal film may be a single layer of one metal or an alloy layer or comprise two or more metal layers laminated on each other. Preferably, the amorphous film on the developer support is formed by a chemical conversion treatment using a solution containing chromate or zinc phosphate. Preferably, the developer support has irregularities of Ra 0.1–2.0 μm on its surface.

According to another aspect of the invention, there is provided a method of manufacturing a developer support comprising the steps of preparing a treatment liquid containing a chromic acid, forming a chrome family film on the surface of a hollow cylindrical substrate using the treatment liquid as a chemical conversion treatment step, preparing a treatment liquid for reduction, and reducing hexavalent chromium in the chrome family film using the reducing treatment liquid.

Preferably, the reducing treatment liquid is, for example, an aqueous solution prepared to pH 2.5 to 4 containing at least one substance of sodium hydrogen sulfite, sodium sulfite, and ferrous sulfate or an aqueous solution prepared to pH 2.5 to 4 containing at least one substance of hydrazine hydrade and sodium thiosulfate.

DETAILED DESCRIPTION OF THE PREFERRED EMBODIMENTS

Referring now to the accompanying drawings, there is shown one preferred embodiment of the invention.

Figure 1:
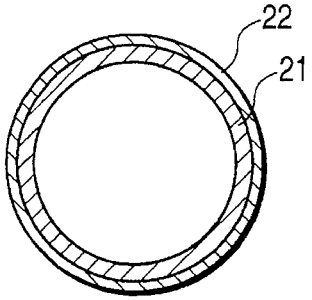
FIG. 1 is a sectional view showing the structure of a developer support used with a developing apparatus according to one embodiment of the invention.
Figure 4:
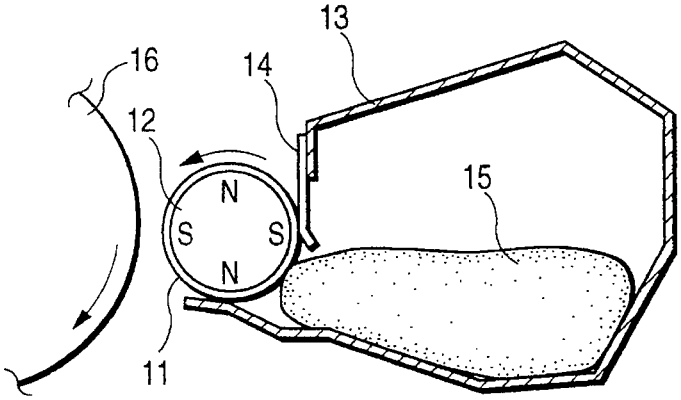
FIG. 4 is a drawing showing an outline of the configuration of a developing apparatus.

FIG. 1 shows the sectional structure of a developer support used with a developing apparatus according to one embodiment of the invention. The developer support comprises a substrate 21 consisting of a hollow cylinder and an amorphous film 22 formed on the surface thereof. First, an example in which aluminum is used as the substrate 21 is discussed.

A film on an aluminum substrate was formed by dipping the substrate in treatment liquids having various compositions. Here, an aluminum substrate having a mirror-like surface is used. Table 1 lists typical treatment liquid compositions used for the treatment. The film forming methods using treatment liquids 1, 2, 3, and 4 listed in the table are generally called an alkali chromate process, chromate process, phosphoric acid chromate process, and zinc phosphate process respectively. The film formation conditions, which vary depending on the type of treatment liquid and the film thickness of the amorphous film to be formed, are as follows: The treatment temperature is from room temperature to 90° C. and the treatment time is 30 seconds to 30 minutes. Films having a thickness of about 1 μm to 20 μm can be obtained under the treatment conditions. The film thickness is evaluated by observing the section of each film under a scanning electron microscope.

TABLE 1

| | Composition (weight %) |
|---|---|
| Treatment liquid 1 | $Na_2CO_3$ 5%, $Na_2CrO_4$ 1.5% |
| Treatment liquid 2 | $CrO_3$ 0.4%, $Na_2CrO_4$ 0.4%, NaF 0.1% |
| Treatment liquid 3 | $PO_4^{3-}$ 5%, $F^-$ 0.2%, $CrO_3$ 1% |
| Treatment liquid 4 | $Zn^{2+}$ 0.7%, $PO_4^{3-}$ 1%, $NO_3^-$ 2%, $BF_4^-$ 1% |

In the treatment using treatment liquids 1 to 3, a film containing substrate elements Al 8–15% and Cr 20–30% was formed on the aluminum substrate surface. Other components are oxygen and hydrogen when treatment liquids 1 and 2 are used; oxygen, hydrogen, and phosphorus when treatment liquid 3 is used. When treatment liquid 4 was used, a film containing Al 2% and Zn about 35% was formed. The formed film is amorphous. For example, when treatment liquid 3 is used, an amorphous film containing phosphoric acid radical or water of crystallization as represented by a molecular formula of $Al_2O_3$ $2CrPO_4$ $8H_2O$ is formed.

Figure 5:
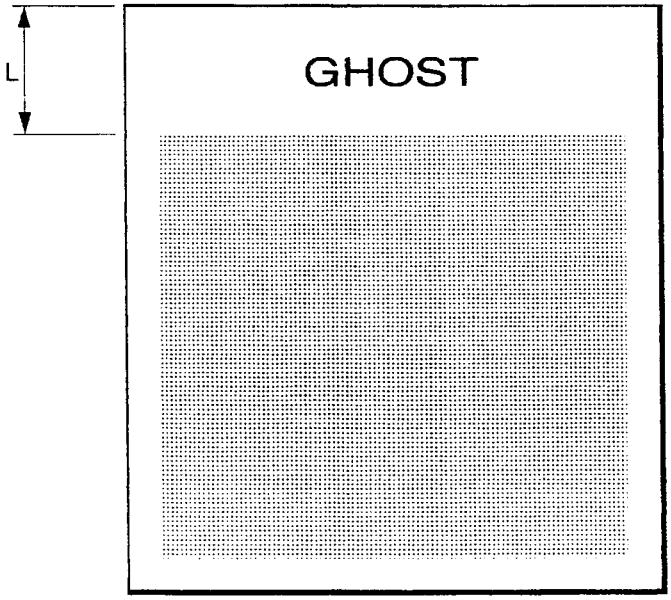
FIG. 5 is an illustration of a manuscript used to explain a ghost, a problem of conventional developing apparatus.

To evaluate the ghost suppression effect of specimens prepared with the treatment liquids, a prepared developer support was built in a copier and an image to cause a ghost to easily occur as shown in FIG. 5 was copied, then the print result was checked visually. Here, a specimen where a film having a thickness of 2 μm is prepared is used. To compare the effect of the embodiment, several comparative specimens were provided and evaluated as the specimens. Table 2 lists the evaluation results of the ghost suppression effect.

In the table, the symbols O, Δ, and X denote the degree of the ghost suppression effect; they indicate the specimens with no ghost occurring as the print result, those with a slight ghost occurring as the print result, and those with a clear ghost occurring as the print result respectively. Comparative specimens 1 and 2 are those used traditionally as developer supports, and an aluminum oxide layer on the surface of the specimen 2 was prepared by anodizing.

TABLE 2

| Specimen name | Substrate material | Film preparation process or film material | Effect |
|---|---|---|---|
| Specimen 1 | Al | Treatment liquid 1 | O |
| Specimen 2 | Al | Treatment liquid 2 | O |
| Specimen 3 | Al | Treatment liquid 3 | O |
| Specimen 4 | Al | Treatment liquid 4 | O |
| Comparative Specimen 1 | Al | None | X |
| Comparative Specimen 2 | Al | Aluminum oxide | X |
| Comparative Specimen 3 | Al | Chrome metal | Δ |
| Comparative Specimen 4 | Al | Chrome oxide; coating percentage 50% | Δ |

Comparative specimens 3 and 4 are provided considering that most developer supports of the embodiment have Cr on the surfaces thereof. The comparative specimen 3 is disclosed as a developing roller in Japanese Patent Laid-Open No.3-41485 and the comparative specimen 4 is similar to the device disclosed as a magnet roller in Japanese Patent Laid-Open No.4-309982. These are techniques for improving durability of the rollers and the ghost suppression effect is not described here.

As seen in the table 2, the specimens 1–4 provided by treating their surfaces with the treatment liquids 1–4 demonstrate the excellent ghost suppression effect as compared with the comparative specimens. From comparison of the ghost suppression effect of the specimens 1–3 with that of the comparative specimens 3 and 4, it is found that the ghost suppression effect of the embodiment is produced by an amorphous compound film consisting essentially of a metal element, oxygen, and hydrogen formed on the surface rather than Cr existing on the surface. This is also clarified by the fact that a similar ghost suppression effect is also provided at the specimen 4 containing no Cr element on the surface.

Next, an example in which different material from aluminum is used as substrate material is discussed.

Here, with Zn, Ni as the substrate material, specimens comprising films prepared with the treatment liquids 2 and 3 for the substrate material were prepared and compared with comparative specimens with no films formed. Table 3 lists the evaluation results.

TABLE 3

| Specimen name | Substrate material | Film preparation process or film material | Effect |
|---|---|---|---|
| Specimen 5 | An | Treatment liquid 2 | O |
| Specimen 6 | Zn | Treatment liquid 3 | O |
| Specimen 7 | Ni | Treatment liquid 2 | O |
| Specimen 8 | Ni | Treatment liquid 3 | O |
| Comparative specimen 5 | Zn | None | X |
| Comparative specimen 6 | Ni | None | X |

Also as seen in the comparison results, if substrate material other than aluminum is used, the excellent ghost suppression effect is produced by forming a compound layer on the surface with the treatment liquid described above. This indicates that in the invention, metal elements making films are not specified and that the source of the ghost suppression effect is considered to be compounds consisting of hydroxyl, water of crystallization, phosphoric acid radical, etc.

The ghost suppression effect of the invention is produced by forming a predetermined compound film on the developer support surface, and the preparation method is not limited to the above-mentioned methods. For example, a surface layer containing predetermined metal is formed and can also be treated with acid, alkali. The substrate material of the developer support is not limited to metal either. For example, a developer support comprising a metal layer as a base layer of an amorphous film formed on the plastic surface like a hollow cylinder can be used. Table 4 lists the evaluation results of the ghost suppression effect of developer supports prepared by dipping a metal layer formed on the plastic surface in treatment liquids.

TABLE 4

| Specimen name | Base layer | Film preparation process or film material | Effect |
|---|---|---|---|
| Specimen 9 | Zn | Treatment liquid 3 | O |
| Specimen 10 | Ni | Treatment liquid 3 | O |
| Specimen 11 | Sn | Treatment liquid 3 | O |
| Specimen 12 | Cu | Treatment liquid 3 | O |
| Specimen 13 | Cr | Treatment liquid 4 | O |
| Specimen 14 | Al | Treatment liquid 3 | O |

The metal material is formed by a vacuum deposition process, and the formed film is about 20 μm thick. As seen in the table, a similar ghost suppression effect to that with the specimens 1–8 was also produced in the example. According to the method, metal such as Sn that cannot be used as a substrate because it would be easily deformed as a single unit can also be used as amorphous film component material. Although the vacuum deposition process was used to prepare the metal base layer, any other film forming process such as sputtering, chemical vapor phase growth process, or plating can also be used. The base layer need not be a single layer; for example, to raise the adhesive property of material on which a base layer is formed and the base layer, another metal layer may be formed between them. Further, the base layer may be an alloy thereof. The above-mentioned plastic portion may be material such as an oxide or alloy, of course.

Next, the results of an experiment made to quantitatively evaluate the ghost suppression effect of the embodiment are shown. As described above, a ghost occurs because a developing capability distribution is formed in a developer on a developer support. The developing capability difference occurs mainly due to the charge amount difference of the developer. Thus, the average charge amount of the developer on the developer support surface different in history was measured. The above-mentioned specimen 2 and comparative specimen 2 were used for measurement. To measure the average charge amount, the developer on the developer support was sucked and the total weight and total charge amount of the sucked developer were measured. Table 5 lists the measurement results.

TABLE 5

| Specimen name | Average charge amount (−μC/g) After white print | After black print | Ratio (%) |
|---|---|---|---|
| Specimen 2 | 6 | 5 | 83 |
| Comparative specimen 2 | 23 | 14 | 61 |

In Table 5, the average charge amount after a plurality of white sheets of print are printed is entered under the column "After white print" and the average charge amount of a newly supplied and charged developer after black print is made is entered under the column "After black print." Under the column "Ratio," the ratio of the average charge amount after black print to that after white print is entered in percentage. The higher the percentage, the higher is the ghost suppression effect. Thus, at the developer support with aluminum oxide formed on the surface used as the comparative specimen, the average charge amount varies greatly depending on the history. In contrast, at the developer support of the embodiment, the average charge amount difference depending on the history can be lessened as seen from the percentage.

Next, the effect of the surface roughness degree of a developer support on the ghost suppression effect is described. Here, aluminum substrates having various surface forms were prepared with a sand blast, and the above-mentioned amorphous film forming process was performed on the substrates. The surface roughness degrees of the prepared substrates are Ra 0.05, 0.1, 0.2, 0.5, 1.0, and 2.0 μm. The ghost suppression effect was evaluated for the specimens, as described above. The excellent suppression effect was produced at every specimen. It was observed that the term in which the ghost suppression effect continues is prolonged as the surface roughness degree Ra becomes large. However, the suppression effect continuation term remarkably changes at around Ra 0.05– 0.1; a large change in the ghost suppression effect continuation term is not observed at more than Ra 0.1 μm. The desirable surface roughness degree is about Ra 0.1 to 2.0 μm.

In the embodiment, the results of preparing the films by dipping in the treatment liquids are shown, but films having a similar ghost suppression effect can also be formed by spraying the treatment liquids. The film thickness of each specimen is 2 μm, but the ghost suppression effect does not depend on the film thickness and every film whose thickness is in the range of 1–20 μm used for the evaluation demonstrated an excellent ghost suppression effect.

In the embodiment, the evaluation results with four types of treatment liquids were shown, but treatment liquids are not limited to them. For example, it is observed that a similar ghost suppression effect is produced if a treatment liquid provided by adding $Fe(CN)_6$ to the treatment liquid 2 is used.

Each of the specimens formed with films containing Cr described above has hexavalent chromium ($Cr^{6+}$) as about 10% of Cr. As well known, if a soluble compound of $Cr^{6+}$ enters a human body or contacts with a mucous membrane, it demonstrates toxicity. To use Cr in the form of the invention, a Cr compound peeling off from the developer support surface will be discarded together with toner; the user may touch the waste matter and the waste matter may cause environmental pollution.

In fact, the amount of $Cr^{6+}$ in the waste matter of the apparatus carrying out the invention meets the safety level of hexavalent chromium "0.05 mg/m$^3$ or less," but the amount of $Cr^{6+}$ in the film can also be further reduced by adding a reduction step as described below.

Figure 2:
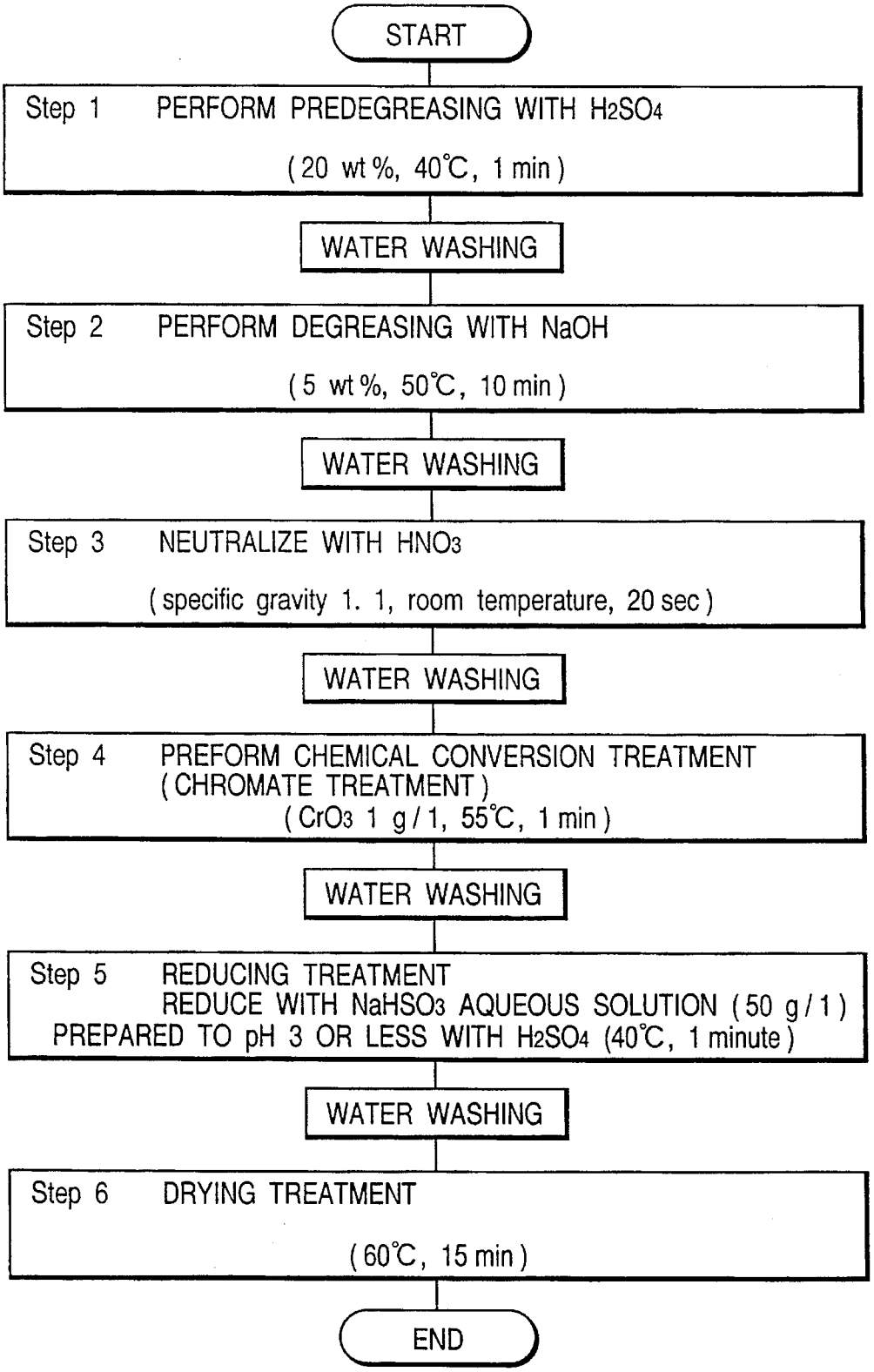
FIG. 2 is a flowchart showing a method of manufacturing a Cr family film when reduction treatment with sodium hydrogen sulfite is performed according to the embodiment.

FIG. 2 shows a method of manufacturing a Cr family film to which a reduction step is added, wherein a tube made of an aluminum alloy "A6063S" ground so that its surface roughness degree becomes Ra 0.15–0.20 μm is used as a substrate.

First, grinding fluid and industrial oil adhering to the substrate after grinding are removed by dipping the substrate in sulfuric acid at concentration of 20 wt % at 40° C. for one minute at step 1. The substrate is washed with water for removing the acid adhering to the surface, then the substrate is dipped in a sodium hydroxide (NaOH) aqueous solution (concentration 5 wt %) at 50° C. for 10 seconds for removing the oxide on the substrate surface at step 2.

The alkali remaining on the substrate is removed (neutralized) by water washing and nitric acid washing at step 3. The acid used at the step may be another acid, such as hydrofluoric acid. After the alkali is neutralized, again the substrate is washed with water and dipped in a treatment liquid containing chromic acid for chemical conversion process at step 4. Here, a treatment liquid containing $CrO_3$ of about 1 g/L is used. The treatment time at step 4 is one minute and the treatment liquid temperature is 55° C.

Next, after the chemical conversion process is stopped by water washing, the substrate with a chrome family film prepared is dipped for one minute in a sodium hydrogen sulfite ($NaHSO_3$) aqueous solution ($NaHSO_3$ concentration 50 g/L, temperature 40° C.) prepared to pH (hydrogen ion exponent) 3 or less with sulfuric acid ($H_2SO_4$), thereby reducing hexavalent chromium at step 5. In the reducing treatment with sodium hydrogen sulfite, pH is prepared to about 3 because if pH is 4 or more, reduction action does not proceed or if pH is 2.5 or less, the film peels off from the substrate when the reducing treatment is performed.

After water washing is performed, the substrate is dried for 15 minutes under a hot wind at 60° C. at step 6 to provide a developer support. If the substrate is exposed to an alkali atmosphere before the water washing step, chromium hydroxide is precipitated on the surface and development bias current flows into a photosensitive body via the chromium hydroxide; as a result, picture quality may be degraded. Thus, preferably the substrate is washed with water immediately after the reducing treatment. If chromium hydroxide is precipitated, the precipitated chromium hydroxide needs to be removed with dilute sulfuric acid or dilute nitric acid having pH 4.5 to 6 or so.

It was observed by analysis that the presence percentage of $Cr^{6+}$ in the Cr family film on the developer support thus provided is about 3% of all Cr amount. As described above, if a Cr family film not subjected to the reducing treatment is used, the amount of $Cr^{6+}$ discharged to the outside of the apparatus because of abrasion of the Cr family film is slight, but the amount of $Cr^{6+}$ discharged to the outside of the apparatus can be further lessened by using the developer support subjected to the reducing treatment.

The reducing treatment liquid used at step 5 is not limited to the sodium hydrogen sulfite aqueous solution (same as aqueous solution of $Na_2S_2O_5$) and sodium sulfite ($Na_2SO_3$) or ferrous sulfate ($FeSO_4$) can also be used, in which case preparation of pH is required.

If an aqueous solution of hydrazine hydrado ($NH_2NH_2$) or sodium thiosulfate is used to reduce $Cr^{6+}$, likewise the presence percentage of $Cr^{6+}$ can be lessened to about 3%.

Figure 3:
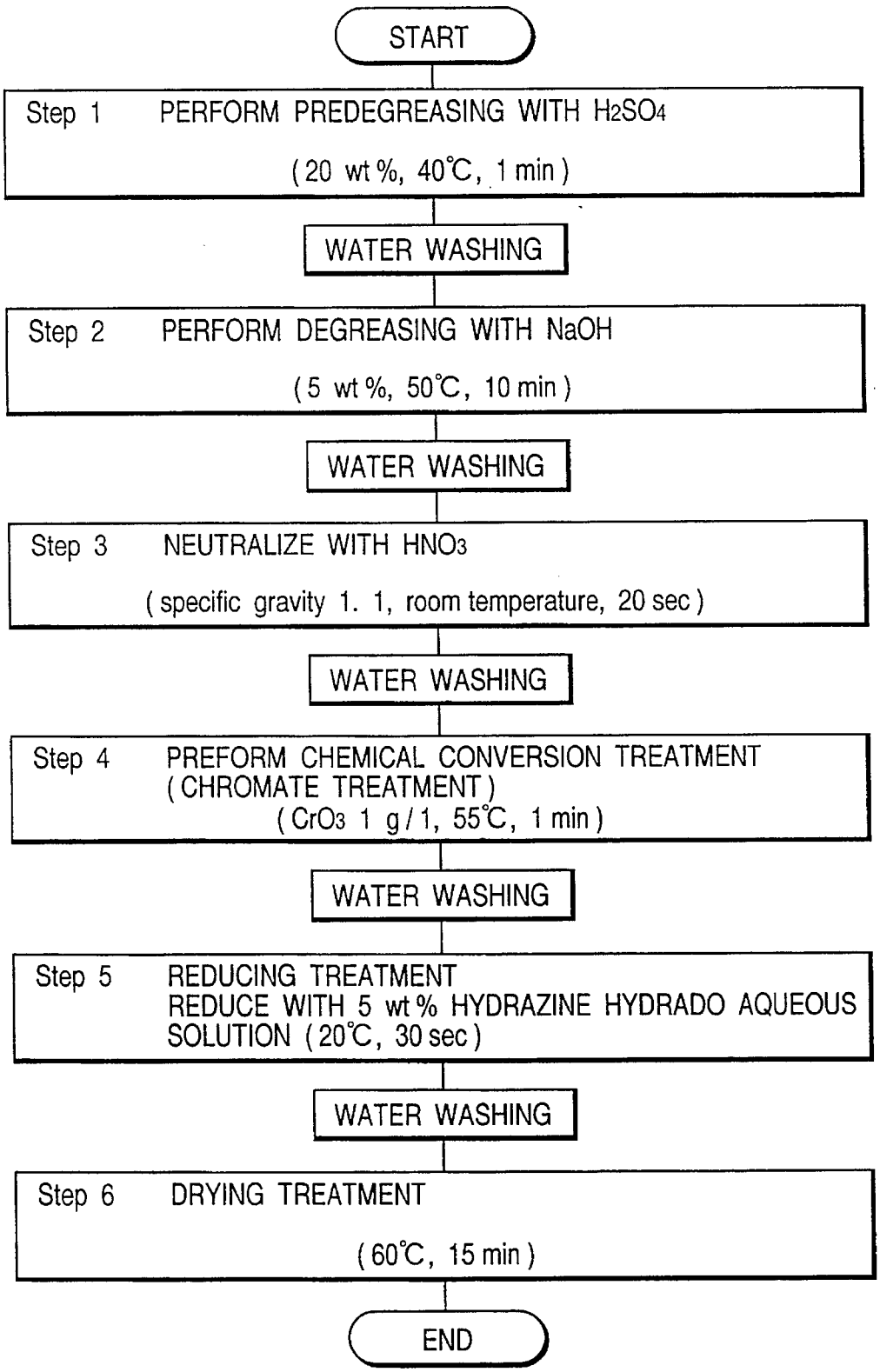
FIG. 3 is a flowchart showing a method of manufacturing a Cr family film when reduction treatment with hydrazine hydrado is performed according to the embodiment.
Figure 6:
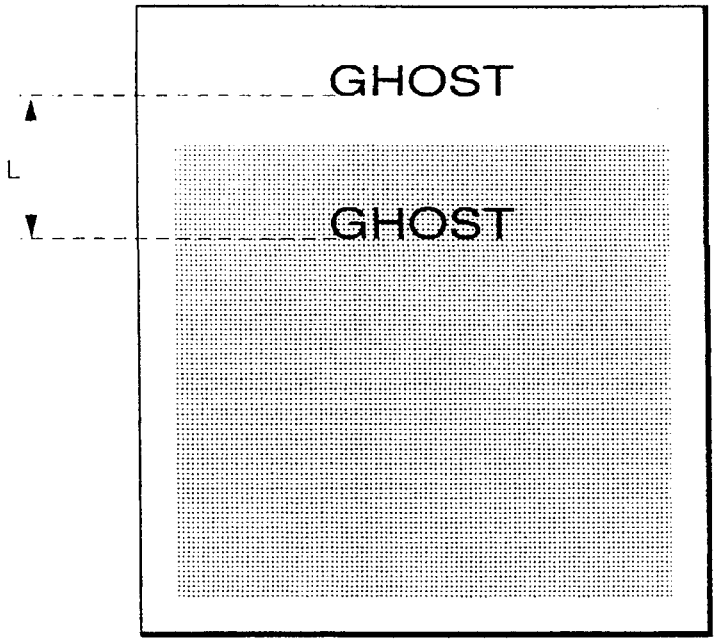
FIG. 6 is an illustration of the print result containing a positive ghost used to explain a ghost, a problem of conventional developing apparatus.
Figure 7:
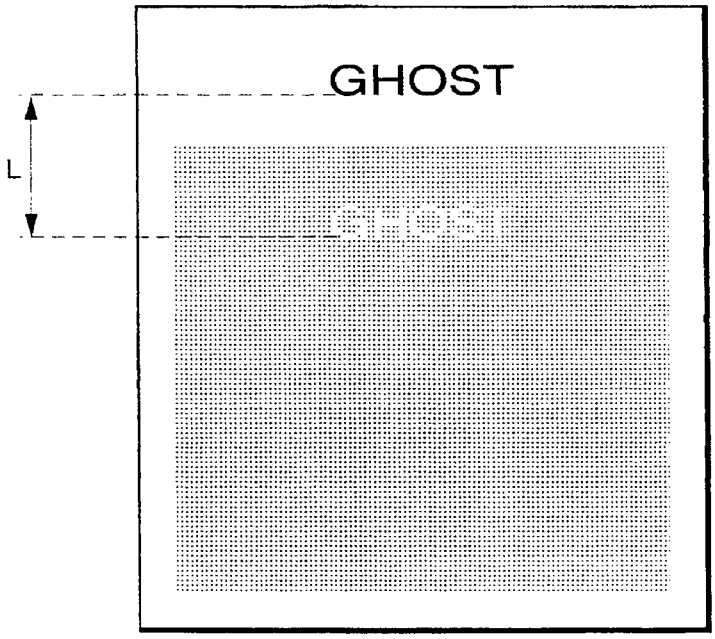
FIG. 7 is an illustration of the print result containing a negative ghost used to explain a ghost, a problem of conventional developing apparatus.

FIG. 3 shows a method of manufacturing a Cr family film when hydrazine hydrado is used. The steps 1–4 and 6 in FIG. 3 are the same as those shown in FIG. 2 and therefore will not be discussed again. To use hydrazine hydrado for reduction at step 5, pH need not be prepared; the substrate is dipped in an aqueous solution of hydrazine hydrado of about 5 wt % at room temperature for about 30 seconds, thereby producing a similar result to that with sodium hydrogen sulfite. Since hydrazine hydrado at high concentration is a liquid strongly emitting smoke in air, here an aqueous solution used for reduction is prepared from a 50-wt % hydrazine hydrado commercially available and the reducing capability is managed by measuring oxidation reduction potential.

It was observed that the developer supports subjected to the reducing treatment by any method described above would provide the same ghost suppression effect as developer supports not subjected to the reducing treatment.

As described above, according to the invention, a developer support supplies a charge developer to an electrostatic latent image formed on the electrostatic latent image holder. The developer support has a nonmagnetic substrate in a shape of a hollow cylinder, wherein the substrate comprises at least one metal with an amorphous film formed on the nonmagnetic substrate. The amorphous film consists essentially of an element selected from Cr or Zn, the at least one metal, O, and H, whereby a ghost caused to occur depending on a developing history can be suppressed for a long period of time for forming an image of high quality.

Nonmetal material can also be used as the substrate by forming a metal film consisting of one or more elements selected from the group consisting of Zn, Ni, Sn, Cu, Cr, and Al on a nonmagnetic material. The ghost can be suppressed for a longer period of time by making the surface roughness degrees of the developer support Ra 0.1–2.0 μm.

According to the method of manufacturing a developer support in the invention, developer supports having the ghost suppression effect and a low content of $Cr^{6+}$ can be provided. Thus, developer supports having a lower possibility of adversely affecting the environment or human bodies can be provided.

What is claimed is:

1. A developing apparatus, comprising:

an electrostatic latent image holder; and a developer support for supplying a charge developer to an electrostatic latent image formed on said electrostatic latent image holder, said developer support having a nonmagnetic substrate in a shape of a hollow cylinder, wherein said substrate comprises at least one metal and an amorphous film formed on said nonmagnetic substrate, wherein said amorphous film consists essentially of an element selected from chrome or zinc, said at least one metal, oxygen, and hydrogen.

2. The developing apparatus as claimed in claim 1, wherein said substrate of said developer support comprises a metal film consisting of one or more elements selected from the group consisting of zinc, nickel, sulphur, copper, chrome, and aluminum formed on a nonmagnetic material.

3. The developing apparatus as claimed in claim 1, wherein said amorphous film is a film formed by a chemical conversion treatment using a solution containing chromate or zinc phosphate.

4. The developing apparatus as claimed in claim 2, wherein said amorphous film is a film formed by a chemical conversion treatment using a solution containing chromate or zinc phosphate.

5. The developing apparatus as claimed in claim 1, wherein said developer support has irregularities of Ra 0.1–2.0 μm on a surface thereof.

6. The developing apparatus as claimed in claim 2, wherein said developer support has irregularities of Ra 0.1–2.0 μm on a surface thereof.

7. The developing apparatus as claimed in claim 3, wherein said developer support has irregularities of Ra 0.1–2.0 μm on a surface thereof.

8. The developing apparatus as claimed in claim 1, wherein said substrate of said developer support is aluminum or aluminum alloy.

9. The developing apparatus as claimed in claim 5, wherein said substrate of said developer support is aluminum or aluminum alloy.

* * * * *